United States Patent [19]

Ragland, Jr. et al.

[11] 4,360,839

[45] Nov. 23, 1982

[54] DEFLECTION YOKE ADJUSTMENT APPARATUS

[75] Inventors: Frank R. Ragland, Jr., Lancaster; Randall W. Martin, Narvon, both of Pa.

[73] Assignee: RCA Corporation, New York, N.Y.

[21] Appl. No.: 142,132

[22] Filed: Apr. 21, 1980

[51] Int. Cl.[3] ..... H01J 9/236

[52] U.S. Cl. ..... 358/249; 335/212

[58] Field of Search ..... 29/25.19, 25.2; 316/27; 335/212; 358/248, 249

[56] References Cited

U.S. PATENT DOCUMENTS

| | | | |
|---|---|---|---|
| 2,456,399 | 12/1948 | Gethmann | 358/248 |
| 3,321,577 | 5/1967 | Burke et al. | 358/248 |
| 3,330,979 | 7/1967 | Constantine | 335/212 |
| 3,657,674 | 4/1972 | Goldammer et al. | 335/212 |
| 3,688,231 | 8/1972 | Van Der Heijde et al. | 335/210 |
| 3,810,053 | 5/1974 | McGlashan | 335/212 |
| 3,861,233 | 1/1975 | Miyamoto | 335/212 |
| 3,950,720 | 4/1976 | Shrader | 358/248 |
| 3,992,578 | 11/1976 | Igarashi | 358/248 |
| 4,006,301 | 2/1977 | Bubacz et al. | 358/248 |
| 4,163,308 | 8/1979 | Tawa et al. | 29/25.19 |

*Primary Examiner*—John McQuade

*Attorney, Agent, or Firm*—P. J. Rasmussen; W. H. Meagher; S. J. Stevens

[57] ABSTRACT

A deflection yoke adjustment apparatus for adjusting a yoke on a kinescope comprises independent coil holders for supporting the horizontal and vertical deflection coils of the yoke. Six elongated positioning rods are attached to particular locations on each coil holder. Actuators, for example stepping motors, move selected ones of the rods to cause translation of the coil holders along a vertical, horizontal or longitudinal axis, or rotation of the coil holder about any of the aforementioned axes. The vertical and horizontal coils may be moved independently to provide an optimum kinescope display. The apparatus also comprises coil alignment devices associated with each positioning rod to maintain coil orientation during movement and force limiting means to protect the kinescope against damage during coil movement.

9 Claims, 7 Drawing Figures

DEFLECTION YOKE ADJUSTMENT APPARATUS

This invention relates to television receivers and in particular to the manufacture of picture tube-deflection yoke combination assemblies. In the manufacture of color television receivers having picture tubes with inline electron guns and self-converging deflection yokes, it is common to provide an integral tube-yoke assembly. This allows the yoke to be individually adjusted for optimum electron beam convergence and attached to the tube prior to final receiver assembly. This yoke adjustment on a production tube may be accomplished through the use of a yoke adjustment machine (YAM), which positions and mounts the yoke on the tube neck and adjusts any associated convergence devices, such as magnets or permeable tabs, through a system of nonmagnetic gears, chains and pulleys. All of the yoke adjustment steps may be done remotely from the front of the YAM by a single operator. The use of the YAM increases the efficiency of the television receiver manufacturing process.

The quality of beam landing and convergence of the tube-yoke combination is determined by the extent to which the individual tube and yoke mismatches may be corrected by the available convergence adjustments. Since the basic yoke is assembled and adjusted on a performance-optimized test kinescope, the practical tube-yoke combination may possess some beam convergence or landing errors that cannot be fully corrected or compensated by the adjustments available to the YAM operator.

In order to eliminate or reduce the extent of the noncorrectable errors in the final tube-yoke assemblies and increase the rate at which such tube-yoke assemblies may be produced, it is desirable to assemble and adjust the basic yoke on the production tube to which it is to be mated. That is, the orientation of the horizontal and vertical deflection coils should be determined with respect to its intended tube, so that manufacturing defect-related errors can be minimized.

The present method of manufacture, however, does not allow this procedure, since, as previously stated, the yoke is assembled with reference to a test kinescope.

In accordance with this invention, a yoke adjusting apparatus is provided which comprises means for optimizing the characteristics of a deflection yoke to a production picture tube. The optimal orientation of the horizontal and vertical coils of the yoke are determined with reference to a particular tube by moving the vertical and horizontal coils along the X, Y and Z axes and rotating the coils about the X, Y and Z axes. The desired orientation of the vertical and horizontal coils may then be fixed with respect to each other to complete the assembly of the yoke. Further convergence and beam landing corrections may then be made to complete the tube-yoke combination.

In accordance with an illustrative embodiment of this invention a deflection yoke adjustment apparatus is provided for use with a television display system comprising a color television kinescope including a neck having a longitudinal axis and incorporating means disposed within the kinescope neck for producing three electron beams. Also provided is a deflection yoke comprising horizontal deflection coils for deflecting the electron beams in horizontal directions orthogonal to the longitudinal axis and vertical deflection coils for deflecting the electron beams in vertical directions orthogonal to the longitudinal axis. The deflection yoke adjustment apparatus comprises a support structure receiving the kinescope and incorporating electrical means for energizing the kinescope, a horizontal deflection coil holder for supporting the horizontal deflection coils and a vertical deflection coil holder for supporting the vertical deflection coils.

A first plurality of moveable positioning rods are coupled to respectively different regions of the horizontal coil holder for supporting the horizontal coil holder in such manner as to dispose the horizontal deflection coils in a location encircling the kinescope neck. A second plurality of moveable positioning rods are coupled to respectively different regions of the vertical deflection coil holder for supporting the vertical coil holder in such manner as to dispose the vertical deflection coils in a location encircling the horizontal deflection coils. Each of the pluralities of moveable positioning rods include a positioning rod selectively subject to motion in a direction parallel to the directions of horizontal deflection, a plurality of positioning rods selectively subject to motion in a direction substantially parallel to the longitudinal axis, and a plurality of positioning rods selectively subject to motion in a direction substantially parallel to the directions of vertical deflection.

A plurality of selectively operable actuating means are mounted on the support structure for adjusting the orientation of the deflection coils with respect to the kinescope neck with each of the actuating means being coupled to a respectively different one of the positioning rods, wherein respectively different patterns of selective operation of selected ones of the actuating means effect translation of a selected one of the deflection coils along an axis substantially parallel to the directions of horizontal deflection, translation of a selected one of the deflection coils along an axis substantially parallel to the longitudinal axis, translation of a selected one of the deflection coils along an axis substantially parallel to the directions of vertical deflection, rotation of a selected one of the coils about an axis substantially parallel to the directions of horizontal deflection, rotation of a selected one of the coils about an axis substantially parallel to the longitudinal axis, and rotation of a selected one of the coils about an axis substantially parallel to the directions of vertical deflection.

In the accompanying drawing.

Figure 3:
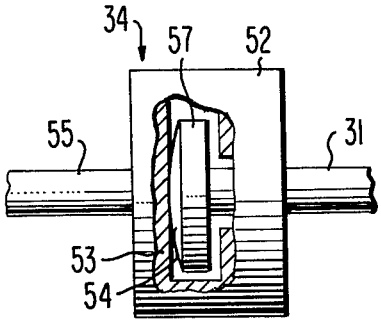
FIG. 3 is a cross-sectional side elevational view of a coil alignment device in accordance with the present invention.
Figure 4A:
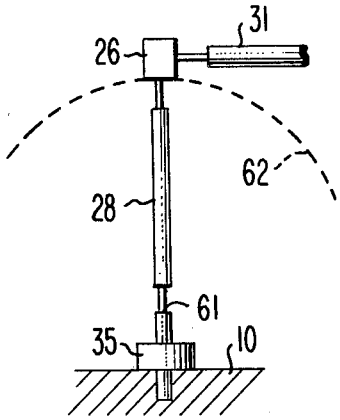
Figure 4B:
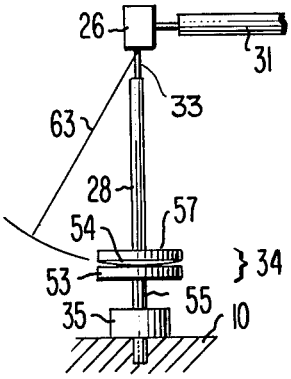

FIGS. 4*a* and 4*b* illustrate the principle of operation of the coil alignment device shown in FIG. 3.

Figure 6:
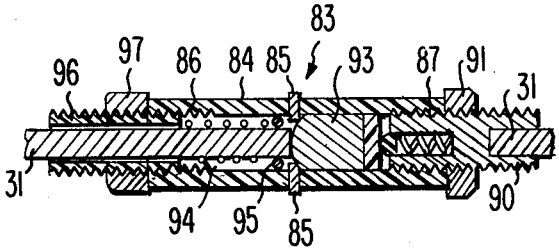
Figure 5:
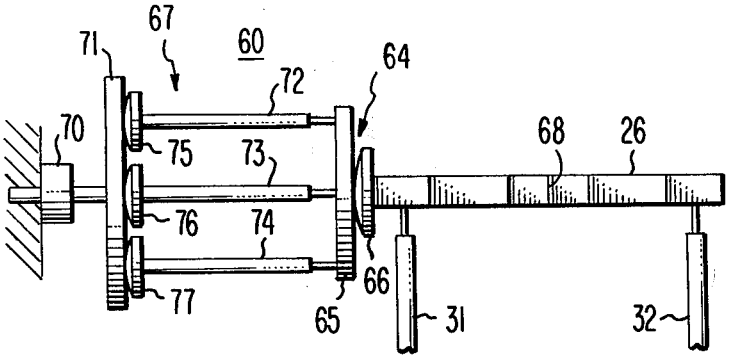

FIG. 5 illustrates the principle of operation of a further embodiment of the coil alignment device shown in FIG. 3; and FIG. 6 is a cross-sectional side elevational view of a force limiting apparatus in accordance with the present invention.

Figure 1:
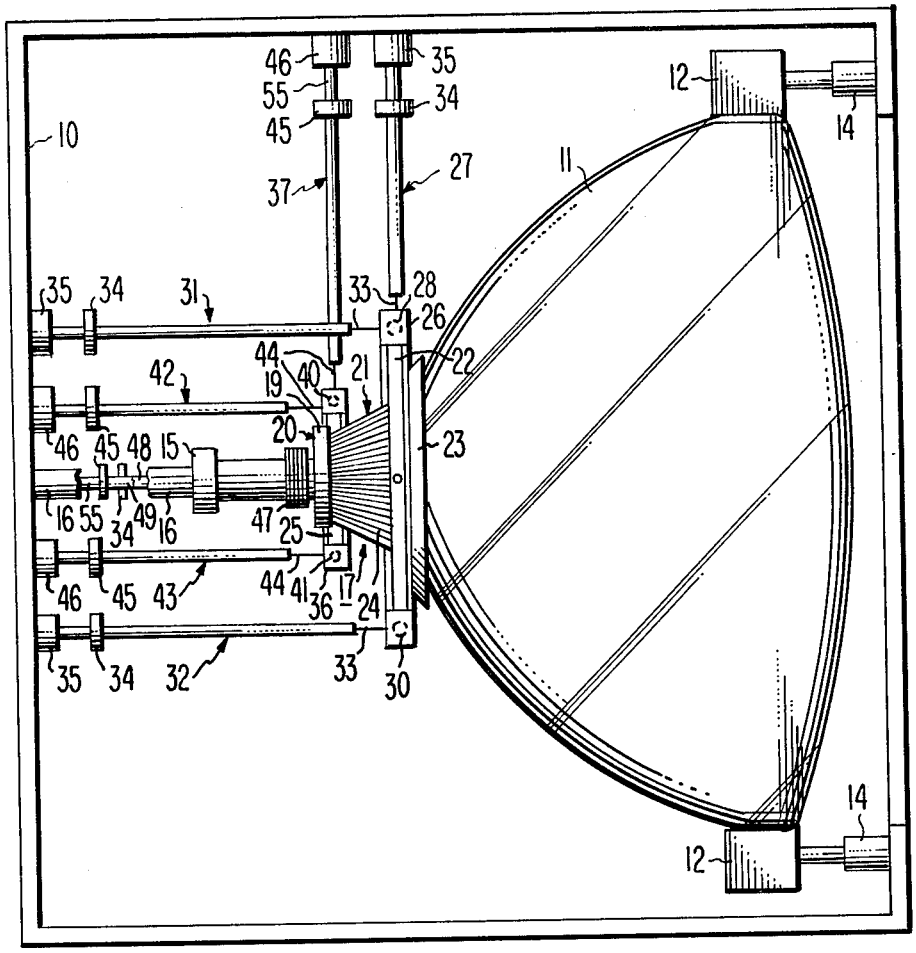
FIG. 1 is a top plan view of a yoke adjustment apparatus in accordance with the present invention.

Referring to FIG. 1, there is shown a deflection yoke adjustment apparatus comprising a housing 10 incorporating electronic circuitry (not shown) capable of energizing a color television kinescope in a manner similar to that accomplished by a television receiver. The yoke adjustment apparatus is adapted to receive a kinescope 11 by way of tube clamping means 12 which firmly supports kinescope 11 near its front portion. Clamping means 12 is coupled to telescoping members 14 which can move the kinescope 11 along its longitudinal or Z-axis for proper positioning. Electrical contact 15 connects with the electrical terminal pins at the end of the tube neck and supplies the power and signals necessary to operate the tube. Telescoping member 16 is coupled to electrical contact 15 and is moveable in order to bring the contact 15 into proper contact with the tube 11.

A deflection yoke 17, comprising a horizontal coil assembly 20 and a vertical coil assembly 21, is disposed about the neck of the kinescope 11. The horizontal coil assembly 20 and the vertical coil assembly 21 are free to move with respect to each other. The horizontal coil assembly 20 comprises a yoke coil insulator 19 having a funnel shape. A pair of saddle-would horizontal deflection coils (not shown) are mounted to the interior of the insulator 19. A yoke mounting bracket 22 is attached to the perimeter of the flared front portion of the insulator 19. The mounting bracket 22 mates with a picture tube funnel ring 23, which is fixedly mounted to the kinescope 11, for attaching the yoke 17 to the kinescope 11. The vertical coil assembly 21 comprises a ferrite core, around which is wound a toroidal vertical deflection coil 24. Positioning pieces 25 are attached to the ferrite core and extend outwardly on opposite sides of the core. The vertical coil assembly 21 fits around the outside of the insulator 19.

The mounting bracket 22 of the horizontal coil assembly 20 is disposed within a U-shaped coil holding support frame 26. The appearance of support frame 26 can be seen more clearly in FIG. 2. Support frame 26 is coupled to positioning rods 27, 28, 30, 31, 32 and 48. Each of rods 27, 28, 30, 31, 32 and 48 comprises a thin attachment wire designated generally as 33, which attaches directly to support frame 26. Each of the positioning rods is coupled through a coil alignment device, designated generally as 34, and an actuator, designated generally as 35, to the housing 10.

The vertical coil assembly 21 is disposed within a U-shaped support frame 36 by engagement between the support frame 36 and the positioning pieces 25 of the vertical coil assembly 21. Support frame 36 is similar in appearance to support frame 26. Support frame 36 is similarly coupled to housing 10 through positioning rods 37, 40, 41, 42, 43 and 49, a coil alignment device designated generally as 45, and an actuator, designated generally as 46. Each of the rods 37, 40, 41, 42, 43 and 49 also comprises a thin attachment wire, designated generally as 44 which attaches directly to support frame 36. In FIG. 1, telescoping member 16 is shown broken away to illustrate the location of positioning rods 49. Positioning rod 49 is shown further broken away to show the location of positioning rod 48.

The yoke adjustment apparatus shown in FIG. 1 may be incorporated as a part of a yoke adjustment machine (YAM). The YAM comprises additional operating arms (not shown) which can adjust static convergence magnets 47 located on the tube neck, or other convergence magnets or permeable tabs located on the yoke itself. The YAM also includes means for easy loading of the tube into the YAM, thereby decreasing the time necessary to process a tube. Incorporation of the yoke adjustment apparatus of FIG. 1 into a YAM allows a standard production yoke and tube to be optimally matched to one another for best overall electron beam convergence.

Figure 2:
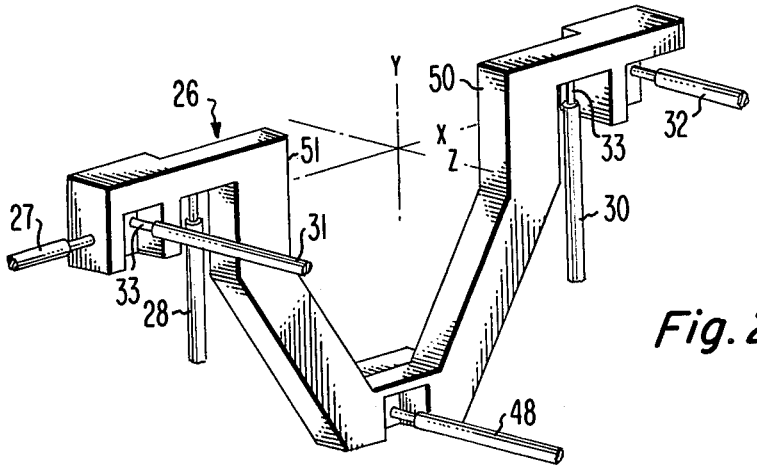
FIG. 2 is a perspective view of a representative coil holding means of the yoke adjustment apparatus shown in FIG. 1.

Referring to FIGS. 1 and 2, the operation of the yoke adjustment apparatus will now be described, FIG. 2 illustrates U-shaped support frame 26. Support frame 36 is similar in appearance and operates in the same manner. Positioning rods 27, 28, 30, 31, 32 and 48 can be seen extending from support frame 26. As can be seen in FIG. 2, positioning rod 27 is oriented parallel to a designated X-axis, rods 28 and 30 are oriented parallel to a designated Y-axis and rods 31, 32 and 48 are oriented parallel to a designated Z-axis. From FIG. 1 it can be seen that the longitudinal axis of the kinescope 11 is oriented parallel to the Z-axis. The X, Y and Z-axis are mutually orthogonal. The horizontal coil assembly 20 is held in place between the vertical facing surfaces 50 and 51 of coil holding support frame 26. Additional positioning and holding members, which aid in maintaining coil assembly 20 securely between surfaces 50 and 51 are not shown.

It is possible to vary the orientation of the coil assembly 20, and hence the orientation of the horizontal deflection coils, by selectively moving rods 27, 28, 30, 31, 32 and 48. Moving rod 27 moves support frame 26 parallel to the X-axis. Moving rods 28 and 30 in the same direction moves support frame 26 parallel to the Y-axis and moving rods 31, 32 and 48 in the same direction moves support frame 26 parallel to the Z-axis. Moving rod 48 alone causes the support frame 26 to rotate about the X-axis. Moving rods 31 and 32 equally in opposite directions causes the support frame 26 to rotate about the Y-axis. Rotation of support frame 26 about the Z-axis is accomplished by moving rods 28 and 30 equally in opposite directions. Movement of the aforementioned positioning rods is realized through operation of actuators 35. By way of example, actuators 35 and 46 may comprise stepping motors. Corresponding motion of support frame 36 is accomplished by movement of similarly located rods 37, 40, 41, 42, 43 and 49 in the manner just described, by way of actuator 46. Positioning rod 49 is attached to support frame 36 at a location corresponding to the point of attachment of rod 48 to support frame 26.

The yoke 17 may therefore be optimized for best electron beam convergence on a particular kinescope 11 by adjusting the orientation of the horizontal and vertical deflection coils with respect to each other and to the kinescope display screen axes. The thin attachment wires 33 and 45 with couple each positioning rod to its respective support frame has sufficient rigidity to impart the necessary force to move the support frame without deformation to the wire, yet maintaining enough flexibility to bend when the support frame's direction of motion is perpendicular to the orientation of the positioning rod. When the optimum orientation of the yoke 17 with respect to kinescope 11 is reached, the positioning of the horizontal and vertical coils is fixed with respect to each other, for example, by gluing the coils together. The integral yoke 17 may then be mounted to the kinescope 11 by attaching the yoke attachment frame 22 to the kinescope funnel ring 23. One method of attachment of the attachment frame to the funnel ring is disclosed in U.S. Pat. No. 3,950,720—Shrader.

FIG. 3 illustrates a representative coil alignment device 34 associated with representative positioning rod 31 coupled to support frame 26. Alignment device 34 comprises a housing 52 incorporating an internal flat surface 53. The housing 52 is mounted on the end of a rod 55 which in turn is coupled to actuator 35. The orientation apparatus 34 also comprises disk 57 disposed within housing 52. Positioning rod 31 extends from one face of disk 57. The opposite face of disk 57 defines a convex surface 54. The radius of the convex surface 54 defined is equal to the distance from the convex face 54 of disk 57 to the point of attachment of wire 33 to support frame 26. The convex face 54 of disk 57 contacts flat surfaces 53 within housing 52. By referring to FIGS. 4*a* and 4*b* the significance of this construction will be described.

FIG. 4*a* illustrates support frame 26 coupled to housing 10 through positioning rods 28 and 31 and actuator 35. Coil alignment device 34 is not present in FIG. 4*a*. When rod 31 is moved in order to move support frame 26 in a Z-axis direction, positioning rod 28 will pivot about its point of attachment 61 to actuator 35. This pivoting of positioning rod 28 causes support frame 26 to follow arc 62, thereby undesirably changing the Y-axis coordinate of support frame 26. Although it is not shown in FIG. 4*a*, movement of rod 31 also undesirably changes the X-axis coordinate of support frame 26 since the X-axis positioning rods are attached to support frame 26 also and movement along the Z-axis causes pivotal movement about the X-axis rods. Similarly, desired motion of the support frame 26 along any axis causes undesirable motion along the other two axes. This undesirable motion adversely affects the adjustment of the yoke, making it extremely difficult to achieve optimum electron beam convergence.

FIG. 4*b* illustrates support frame 26, positioning rod 31 and positioning rod 28 with coil alignment device 34 in place, as shown in FIG. 1. As the support frame 26 is moved in a Z-axis direction by movement of positioning rod 31, the convex surface of disk 57 of the coil alignment device 34 rolls along flat surface 53 within the interior of housing 52. Since the radius 63 of the convex surface of disk 57 is equal to the distance from disk 57 to support frame 26, the distance from support frame 26 to any point on the convex surface 54 of disk 57 is the same. Therefore, the Y-axis coordinate of support frame 26 will remain constant as the support frame 26 moves in the Z-axis direction. Similarly, coil alignment devices associated with each of the other positioning rods allows movement of their respective support frames along one axis while maintaining constant position along the other two axes. Constant axial position along the X and Y axes is also maintained when the support frames are rotated about the X-axis.

When support frames 26 and 36 are rotated about axes parallel to the designated Y and Z axes, however, constant coil positioning along the X-axis is not possible with the coil alignment devices 34 and 45 shown in FIGS. 1 and 3. This is true because the X-axis is orthogonal to both the axis of rotation and axis of rod movement necessary to cause Y and Z axis rotation, resulting in an X-axis displacement at the center of support frame 26. Although the Y-axis is orthogonal to both the axes of rotation and rod movement for rotation about the X-axis, coil mispositioning does not occur in the apparatus of FIG. 1 since the point of attachment of the Y-axis positioning rods 28 and 30 is along the actual axis of rotation, hence only bending of the attachment wires takes place, and not axial displacement.

Referring to FIG. 5, an apparatus 60 for maintaining constant X-axis coil orientation during Y and Z axis rotation is shown. Again, by way of example, the elements associated with support frame 26 will be used. The apparatus 60 comprises a coil alignment device 64, similar to alignment devices 34 and 45, mounted to the side of support frame 26. The device 64 comprises a base member 65 and a convex-surfaced member 66, mounted to the support frame 26. The radius of the convex surface of member 66 is equal to the distance from the convex surface to point 68, the intersection of the Y and Z axes of rotation of the support frame 26.

The apparatus 60 also comprises a second coil alignment device 67 coupled between the coil alignment device 64 and housing 10. The alignment device 67 comprises an actuator 70 similar to actuators 35 and 46 coupled between housing 10 and a base member 71 of alignment device 67. Three rods 72, 73 and 74 are coupled between base member 65 of alignment device 64 and base member 71 of alignment device 77 through convex-surfaced members 75, 76 and 77. The radii of the convex surfaces of members 75, 76 and 77 is equal to the distance from each convex surface to the point of attachment of its respective positioning rod to base member 65. Alignment device 64 and alignment device 67 allow support frame 26 to be rotated about its Y and Z axes while still maintaining base members 65 and 71 parallel and equidistant, thereby maintaining a constant X-axis position of support frame 26. It is understood that support frame 36 also may have similar coil alignment devices associated with it to maintain constant X-axis position of support frame 36 during Y and Z axis rotation. Apparatus 60 therefore replaces actuator 35, alignment device 34 and rod 27, shown in FIG. 1.

As an alternative to the coil alignment devices previously described, it is possible to maintain constant axis position of a particular axis during movement along or about a different axis by adjustments made by the positioning rod control system, which operates and controls the actuators which in turn move the positioning rods. Such control system adjustment could compensate for undesired coil position shift by operating the appropriate positioning rods to keep the coil in its proper orientation regardless of the disturbances caused by desired coil movement.

Adjusting the deflection yoke on the kinescope neck requires care that the individual coils on the completed yoke are not forced against the glass of the tube to such an extent that there is danger of damaging or breaking the kinescope glass. In order to prevent such damage to the glass, it is desirable to have some means of limiting the movement of the positioning rods to prevent excessive pressure from being applied to the tube glass. Referring to FIG. 6, there is shown a force limiting means 83 which can be disposed along any or all of the positioning rods controlling the movement of support frames 26 and 36. The positioning rod may be severed at some point along its length and force limiting means 83 then operates to couple the resulting free ends of the severed positioning rod together. For example, force limiting means 83 is shown in place along positioning rod 31.

Force limiting means 83 comprises a tubular electrically insulating housing 84 which incorporates internal threads 86 and 87 at opposite ends of housing 84. A pair of electrical contact pins 85 protrude through the wall of housing 84 into its interior at diametrically opposed positions at a point approximately intermediate between the ends of housing 84. A spring-loaded plunger assembly 90 screws into one end of housing 84 by engagement with threads 87. Plunger 90 is held in position by locking nut 91. One free end of the severed positioning rod fits into an opening in the end of the plunger assembly 90 outside the housing 84, and is held in place by adhesive or similar means. Plunger 90 biases a sliding electrical contact 93 against contact pins 85. The amount of biasing force imparted to contact 93 can be adjusted by the extent to which plunger 90 is screwed into housing 84.

The other free end of the severed positioning rod fits into the end of housing 84 opposite plunger 90, and makes contact with electrical contact 93. A spring 94 is disposed around the end of the positioning rod and is captive at one end by a retaining ring 95, fixedly mounted to the positioning rod. A spring compressor 96 screws into housing 84 by engagement with threads 86. The extent to which compressor 96 is screwed into housing 84 determines the amount of compression of spring 94. Compressor 96 is held in place by a locking nut 97.

Compression of spring 94 biases the end of the positioning rod against sliding contact 93. The power supply to operate the actuator which moves the positioning rod may complete a circuit through contact pins 85, sliding contact 93 and the positioning rod itself. Force limiting means 83 operates by breaking electrical contact in that circuit whenever tension or compression on limiting means 83 exceeds a predetermined amount, thereby disabling the actuator. One alternative to direct connection with the positioning rod actuators has force limiting means 83 controlling an alarm circuit which informs the operator that excessive force is being applied to the kinescope. Other alternatives are of course possible.

Force limiting means 83 operates in the following manner. While the severed positioning rod pieces are being forced toward limiting means 83, a compression condition, one end of the positioning rod attempts to force contact 93 away from its biased contact with contact pins 85. The spring 94 also attempts to force contact 93 away, but the biasing force of plunger 90 can be adjusted to compensate for the force of spring 94. When the compression force exceeds the biasing force of plunger 90, contact 93 will be forced away from pins 85, breaking electrical circuit contact and stopping further motion of the positioning rod.

While the pieces of the positioning rod are being pulled apart, a tension condition, the tension force attempts to pull the positioning rod away from its contact with contact 93. When the tension force exceeds the biasing force of spring 94, the spring will be further compressed as the positioning rod is pulled away from contact 93. Electrical circuit contact is thereby broken, stopping further movement of the positioning rod. By adjusting the spring and plunger biasing forces, the compression and tension force threshold levels can be set where desired, and may even be different.

What is claimed is:

1. A deflection yoke adjustment apparatus, for use with a television display system comprising a color television kinescope including a neck having a longitudinal axis and incorporating means disposed within said kinescope neck for producing three electron beams, and a deflection yoke comprising horizontal deflection coils for deflecting said electron beams in horizontal directions orthogonal to said longitudinal axis and vertical deflection coils for deflecting said electron beams in vertical directions orthogonal to said longitudinal axis; said deflection yoke adjustment apparatus comprising:

a support structure receiving said kinescope and incorporating electrical means for energizing said kinescope;

a horizontal deflection coil holder for supporting said horizontal deflection coils, said holder having a side surface, a trio of rear surfaces, and a pair of bottom surfaces;

a plurality of moveable positioning rods coupled to respective ones of said surfaces of said holder for supporting said holder in such manner as to dispose said horizontal deflection coils in a location encircling said kinescope neck, with said side surface disposed at one side of said longitudinal axis, with two of said rear surfaces respectively disposed on opposite sides of said longitudinal axis, with the remaining one of said rear surfaces vertically displaced with respect to said longitudinal axis, and with said pair of bottom surfaces, respectively disposed on opposite sides of said longitudinal axis;

said plurality of moveable positioning rods including:

a first positioning rod extending substantially parallel to said directions of horizontal deflection and coupled at one end thereof to said side surface;

second, third and fourth positioning rods, each extending substantially parallel to said longitudinal axis, with each of said second and third rods respectively coupled at one end thereof to a respective one of said two rear surfaces, and with said fourth rod coupled at one end thereof to said remaining rear surface; and fifth and sixth positioning rods, each extending substantially parallel to said directions of vertical deflection, with said fifth rod coupled at one end thereof to one of said pair of bottom surfaces, and with said sixth rod coupled at one end thereof to the other of said pair of bottom surfaces; and a plurality of selectively operable actuating means mounted on said support structure for adjusting the orientation of said horizontal deflection coils with respect to said kinescope neck, each of said actuating means being coupled to the remaining end of a respectively different one of said plurality of positioning rods, with the actuating means coupled to said first positioning rod causing movement of said first rod in a direction substantially parallel to said directions of horizontal deflection when selectively operated, with the respective actuating means coupled to said second, third and fourth positioning rods causing movement of the respectively associated rod in a direction substantially parallel to said longitudinal axis when selectively operated, and with the respective actuating means coupled to said fifth and sixth rods causing movement of the respectively associated rod in a direction substantially parallel to said directions of vertical deflection when selectively operated.

2. The deflection yoke adjustment apparatus defined in claim 1, wherein each of said moveable positioning rods is coupled to its respectively associated actuating means via a coil alignment device comprising:

a first member secured to said actuating means and having a substantially flat surface substantially perpendicular to said direction of positioning rod extension; and a second member secured to said rod and having a convex surface contacting said flat surface, said convex surface having a radius equal to the distance from said convex surface to the coil holder surface to which said rod is coupled.

3. The deflection yoke adjustment arrangement defined in claim 2, wherein the coupling of said first positioning rod to said side surface of said coil holder is effected by a coil alignment device comprising:

a first member secured to said positioning rod and having a substantially flat surface substantially perpendicular to said direction of positioning rod extension; and a second member secured to said side surface and having a convex surface contacting said flat surface, said convex surface having a radius equal to the distance from said convex surface to the point of intersection of the axes of said horizontal and longitudinal movement of said coil holder.

4. The deflection yoke adjustment apparatus defined in claim 1 wherein the location of said fourth positioning rod is such that selective movement of said fourth positioning rod causes rotation of said coil holder about an axis parallel to said directions of horizontal deflection.

5. The deflection yoke adjustment apparatus defined in claim 1 wherein the location of said second and third positioning rods is such that selective equal movements of said second and third positioning rods in opposite directions causes rotation of said coil holder about an axis parallel to said direction of vertical deflection.

6. The deflection yoke adjustment apparatus defined in claim 1, wherein the location of said fifth and sixth positioning rods is such that selective equal movements of said fifth and sixth positioning rods in opposite directions causes said coil holder to rotate about an axis parallel to said longitudinal axis.

7. The deflection yoke adjustment apparatus defined in claim 1 wherein said positioning rods are coupled to said coil holder via a force limiting apparatus for limiting the force applied to said coil holder by said actuating means, said force limiting apparatus incorporating electrical contact means, said electrical contact means comprising:

first and second electrical contacts and an intermediate electrical connector, said first contact moveable between a first position contacting said connector and a second position electrically disconnected from said connector, said connector moveable between a first position electrically connecting said connector and said second contact and a second position wherein said connector and said second contact are electrically disconnected;

first biasing means for urging said first electrical contact against said electrical connector with a first predetermined force; and second biasing means for urging said electrical connector against said second electrical contact with a second predetermined force greater than said first predetermined force.

8. The deflection yoke adjustment apparatus defined in claim 1, further comprising:

a vertical deflection coil holder for supporting said vertical deflection coils, said vertical coil holder having a side surface, a trio of rear surfaces, and a pair of bottom surfaces;

an additional plurality of moveable positioning rods coupled to respective ones of said surfaces of said vertical coil holder for supporting said holder in such manner as to dispose said vertical deflection coils in a location encircling said horizontal deflection coils, with said side surface of said vertical coil holder disposed at one side of said longitudinal axis, with two of said rear surfaces of said vertical coil holder respectively disposed on opposite sides of said longitudinal axis, with the remaining one of said rear surfaces of said vertical coil holder vertically displaced with respect to said longitudinal axes, and with said pair of bottom surfaces of said vertical coil holder respectively disposed on opposite sides of said longitudinal axis;

said additional plurality of moveable positioning rods including:

a seventh positioning rod extending substantially parallel to said directions of horizontal deflection and coupled at one end thereof to said side surface of said vertical coil holder;

eighth, ninth and tenth positioning rods, each extending substantially parallel to said longitudinal axis, with each said eighth and ninth rods respectively coupled at one end thereof to a respective one of said two rear surfaces of said vertical coil holder, and with said tenth rod coupled at one end thereof to said remaining rear surface of said vertical coil holder; and eleventh and twelfth positioning rods, each extending substantially parallel to said directions of vertical deflection, with said eleventh rod coupled at one end thereof to one of said pair of bottom surfaces of said vertical coil holder, and with said twelfth rod coupled at one end thereof to the other of said pair of bottom surfaces of said vertical coil holder; and a plurality of selectively operable actuating means mounted on said support structure for adjusting the orientation of said vertical deflection coils with respect to said kinescope neck, each of said actuating means being coupled to the remaining end of a respectively different one of said additional plurality of positioning rods, with the actuating means coupled to said seventh positioning rod causing movement of said seventh rod in a direction substantially parallel to said directions of horizontal deflection when selectively operated, with the respective actuating means coupled to said eighth, ninth and tenth positioning rods causing movement of the respectively associated rod in a direction substantially parallel to said longitudinal axis when selectively operated, and with the respective actuating means coupled to said eleventh and twelfth rods causing movement of the respectively associated rod in a direction substantially parallel to said directions of vertical deflection when selectively operated.

9. A deflection yoke adjustment apparatus, for use with a television display system comprising a color television kinescope including a neck having a longitudinal axis and incorporating means disposed within said kinescope neck for producing three electron beams, and a deflection yoke comprising horizontal deflection coils for deflecting said electron beams in horizontal directions orthogonal to said longitudinal axis and vertical deflection coils for deflecting said electron beams in vertical directions orthogonal to said longitudinal axis; said deflection yoke adjustment apparatus comprising:

a support structure receiving said kinescope and incorporating electrical means for energizing said kinescope;

a horizontal deflection coil holder for supporting said horizontal deflection coils;

a vertical deflection coil holder for supporting said vertical deflection coils;

a first plurality of moveable positioning rods coupled to respectively different regions of said horizontal coil holder for supporting said horizontal coil holder in such manner as to dispose said horizontal deflection coils in a location encircling said kinescope neck;

a second plurality of moveable positioning rods coupled to respectively different regions of said vertical deflection coil holder for supporting said vertical coil holder in such manner as to dispose said vertical deflection coils in a location encircling said horizontal deflection coils;

each of said pluralities of moveable positioning rods including a positioning rod selectively subject to motion in a direction parallel to said directions of horizontal deflection, a plurality of positioning rods selectively subject to motion in a direction substantially parallel to said longitudinal axis, and a plurality of positioning rods selectively subject to motion in a direction substantially parallel to said directions of vertical deflection;

a plurality of selectively operable actuating means mounted on said support structure for adjusting the orientation of said deflection coils with respect to said kinescope neck, each of said actuating means being coupled to a respectively different one of said positioning rods;

wherein respectively different patterns of selective operation of selected ones of said actuating means effect: translation of a selected one of said deflection coils along an axis substantially parallel to said directions of horizontal deflection; translation of a selected one of said deflection coils along an axis substantially parallel to said longitudinal axis; translation of a selected one of said deflection coils along an axis substantially parallel to said directions of vertical deflection; rotation of a selected one of said coils about an axis substantially parallel to said directions of horizontal deflection; rotation of a selected one of said coils about an axis substantially parallel to said longitudinal axis; and rotation of a selected one of said coils about an axis substantially parallel to said directions of vertical deflection.

* * * * *